US008470096B2

(12) United States Patent
Marks

(10) Patent No.: US 8,470,096 B2
(45) Date of Patent: Jun. 25, 2013

(54) PAINT BELL CUP CLEANING METHOD

(75) Inventor: Charles C. Marks, Springfield, OH (US)

(73) Assignee: Honda Motor Co., Ltd., Tokyo (JP)

( * ) Notice: Subject to any disclaimer, the term of this patent is extended or adjusted under 35 U.S.C. 154(b) by 294 days.

(21) Appl. No.: 13/077,121

(22) Filed: Mar. 31, 2011

(65) Prior Publication Data

US 2011/0174338 A1 Jul. 21, 2011

Related U.S. Application Data

(62) Division of application No. 11/831,301, filed on Jul. 31, 2007, now Pat. No. 7,946,298.

(51) Int. Cl.
*B08B 3/02* (2006.01)

(52) U.S. Cl.
USPC ..... 134/38; 134/34; 134/36; 134/37

(58) Field of Classification Search
USPC ..... 134/22.1, 22.18, 34, 36, 37, 38, 44, 134/54, 102.2, 104.2, 198, 200
See application file for complete search history.

(56) References Cited

U.S. PATENT DOCUMENTS

| | | | | |
|---|---|---|---|---|
| 1,789,440 | A | 1/1931 | Hyatt | |
| 1,954,222 | A | 4/1934 | Olson | |
| 4,275,838 | A | 6/1981 | Fangmeyer | |
| 4,605,168 | A | 8/1986 | Tachi et al. | |
| 4,643,357 | A | 2/1987 | Culbertson et al. | |
| 4,830,882 | A | 5/1989 | Ichinose et al. | |
| 4,979,677 | A | 12/1990 | Dankert | |
| 5,183,066 | A * | 2/1993 | Hethcoat | 134/54 |
| 6,363,952 | B1 | 4/2002 | Baioff et al. | |
| 6,569,258 | B2 | 5/2003 | Clifford et al. | |
| 6,582,774 | B2 | 6/2003 | Klein et al. | |
| 7,056,387 | B2 | 6/2006 | van der Steur | |
| 2005/0173018 | A1 | 8/2005 | Herre et al. | |

* cited by examiner

*Primary Examiner* — Saeed T Chaudhry
(74) *Attorney, Agent, or Firm* — Standley Law Group LLP

(57) ABSTRACT

A method for cleaning a bell cup after its removal from a rotary paint atomizer. A device is provided that preferably includes an enclosure within which the bell cup is retained during the cleaning operation. Pressurized cleaning fluid is introduced into the enclosure where it flows over the bell cup and removes paint therefrom. The enclosure may be connected to the nozzle end of a paint spray gun that can be used to deliver the pressurized cleaning fluid thereto.

15 Claims, 5 Drawing Sheets

PAINT BELL CUP CLEANING METHOD

CROSS-REFERENCE TO RELATED APPLICATIONS

This application is a divisional of U.S. patent application Ser. No. 11/831,301, filed Jul. 31, 2007, which is hereby incorporated by reference.

BACKGROUND OF THE INVENTIVE FIELD

The present invention is directed to a method that may be used to clean the bell cup of a rotary paint atomizer. More particularly, the present invention is directed to a method for effectively and efficiently cleaning the bell cup of a rotary paint atomizer after removal of the bell cup therefrom.

A rotary paint atomizer bell cup is a well-known component that need not be described in detail herein. Briefly, however, a bell cup is a rotary paint atomizer component of bell-like or, more commonly, frustoconical shape. During the painting process, the bell cup is rotated at high speed such that when a supply of paint is provided thereto, the paint is transported (centrifuged) toward the rim of the bell cup via the bell cup interior surface or through special passages or channels. The paint is atomized into a fine spray as it is projected from the bell cup rim. The atomized paint particles may be directed toward an object to be painted through the use of an electrostatic charge, a supply of pressurized shaping air, or a combination thereof.

As can be understood from even the brief foregoing description, a bell cup is subjected to contact by paint during use. Consequently, bell cups are periodically cleaned in situ, such at some predetermined interval, prior to a color change, etc. Various well-known techniques for the in situ cleaning of a bell cup exist and would be familiar to one skilled in the art. These in situ cleaning techniques generally involve flushing the bell cup with solvent, preferably while the bell cup is rotating. Pressurized air may be used to assist in the cleaning process.

Eventually, however, paint will accumulate on a bell cup to the point where a more thorough cleaning is required. In this case, the bell cup must generally be removed from the rotary paint atomizer device and cleaned manually. This can be problematic for several reasons. First, bell cups are often constructed of very thin metallic materials that can be easily damaged during handling and cleaning by an operator. Additionally, at least certain bell cups are of a two-piece design that requires separation of their individual components prior to being subjected to a typical manual cleaning process. Because these individual components are commonly covered with a significant amount of paint by the time a manual cleaning process is required, it has been found that separation thereof frequently results in damage of a severity sufficient to render the bell cup unusable.

As it is realized that the periodic removal and manual cleaning of bell cups will likely remain necessary, a non-destructive means by which to accomplish such cleaning is desired. The present invention provides such a bell cup cleaning device and method.

SUMMARY OF THE GENERAL INVENTIVE CONCEPT

Generally speaking, a bell cup cleaning method of the present invention utilizes a cleaning device that includes an enclosure within which a bell cup can be housed during cleaning. The enclosure is adapted for attachment to a supply of pressurized cleaning fluid. Preferably, the enclosure is adapted for attachment to a standard paint gun, such as may have its own paint tank or may be attached to a pressure pot or other supply of pressurized cleaning fluid.

The enclosure preferably threads onto or otherwise attaches to the nozzle portion of such a spray gun after the standard spray cap has been removed therefrom. The enclosure may be formed from two components so as to allow the introduction of a bell cup and the subsequent closing of the enclosure. For example, the enclosure may include a body portion having a threaded opening that receives a like-threaded cap or lid for the sealing thereof.

Once the enclosure has been attached to the spray gun and a bell cup has been placed within the enclosure, cleaning of the bell cup may commence. Operation of the spray gun, such as by normal activation of its trigger, causes pressurized cleaning fluid from a source such as mentioned above to flood the enclosure. One or more fluid outlets are preferably provided to allow cleaning fluid to exit the enclosure after passing through or over the bell cup. A bell cup cleaning device of the present invention can be held over a collection vessel during use such that cleaning fluid exiting the enclosure may be collected.

The passage of cleaning fluid through and over the bell cup produces a flushing and cleaning action that effectively removes paint buildup therefrom. As such, paint buildup can be adequately removed from a bell cup without requiring a manual cleaning operation, such as scrubbing with a brush. Additionally, two-piece bell cups may be cleaned according to the present invention without requiring the prior disassembly thereof. Decreased handling and elimination of the need for disassembly of two-piece bell cups greatly reduces damage thereto.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
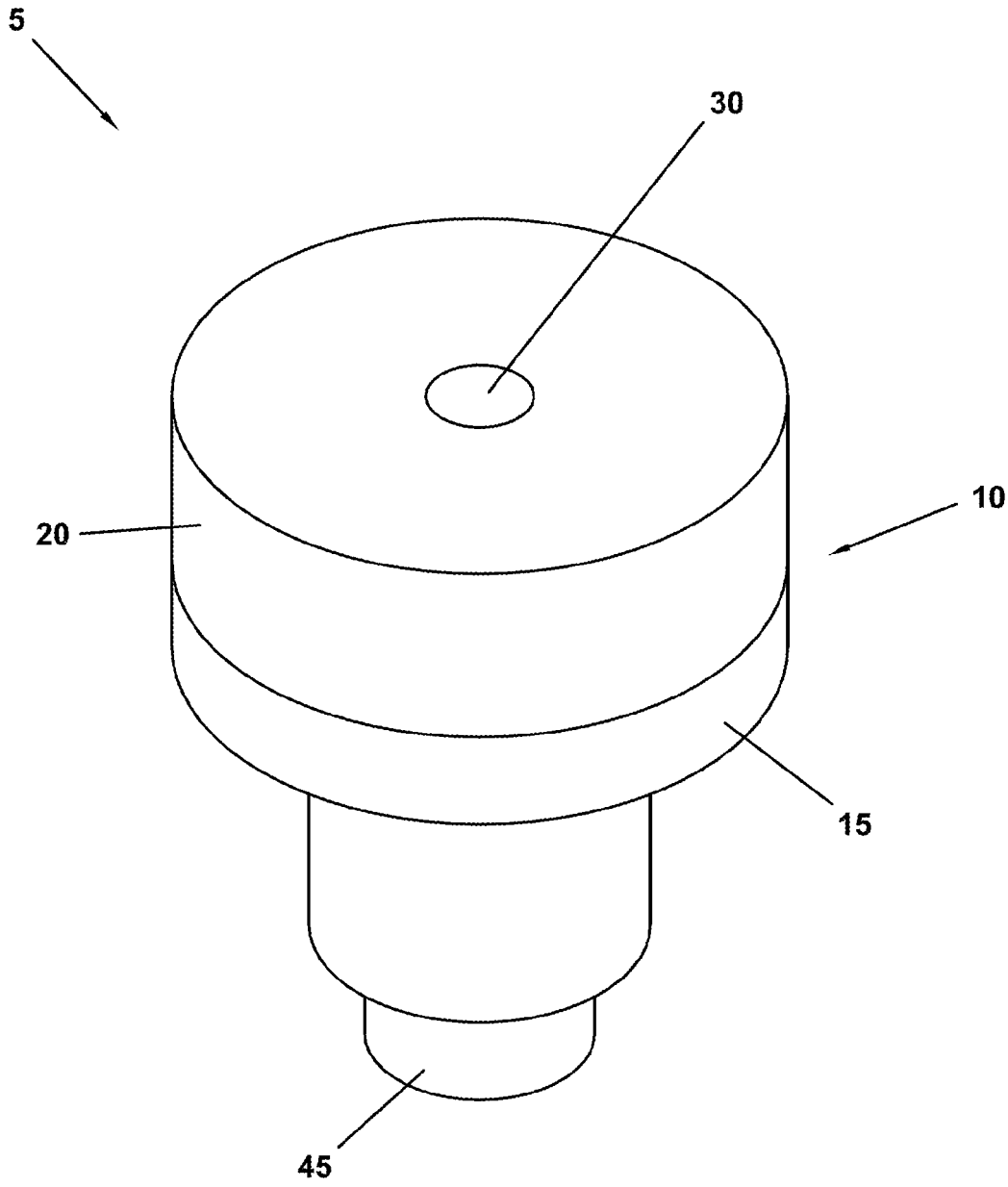
FIG. 1 is an isometric view of one exemplary embodiment of an assembled bell cup cleaning device of the present invention.
Figure 2:
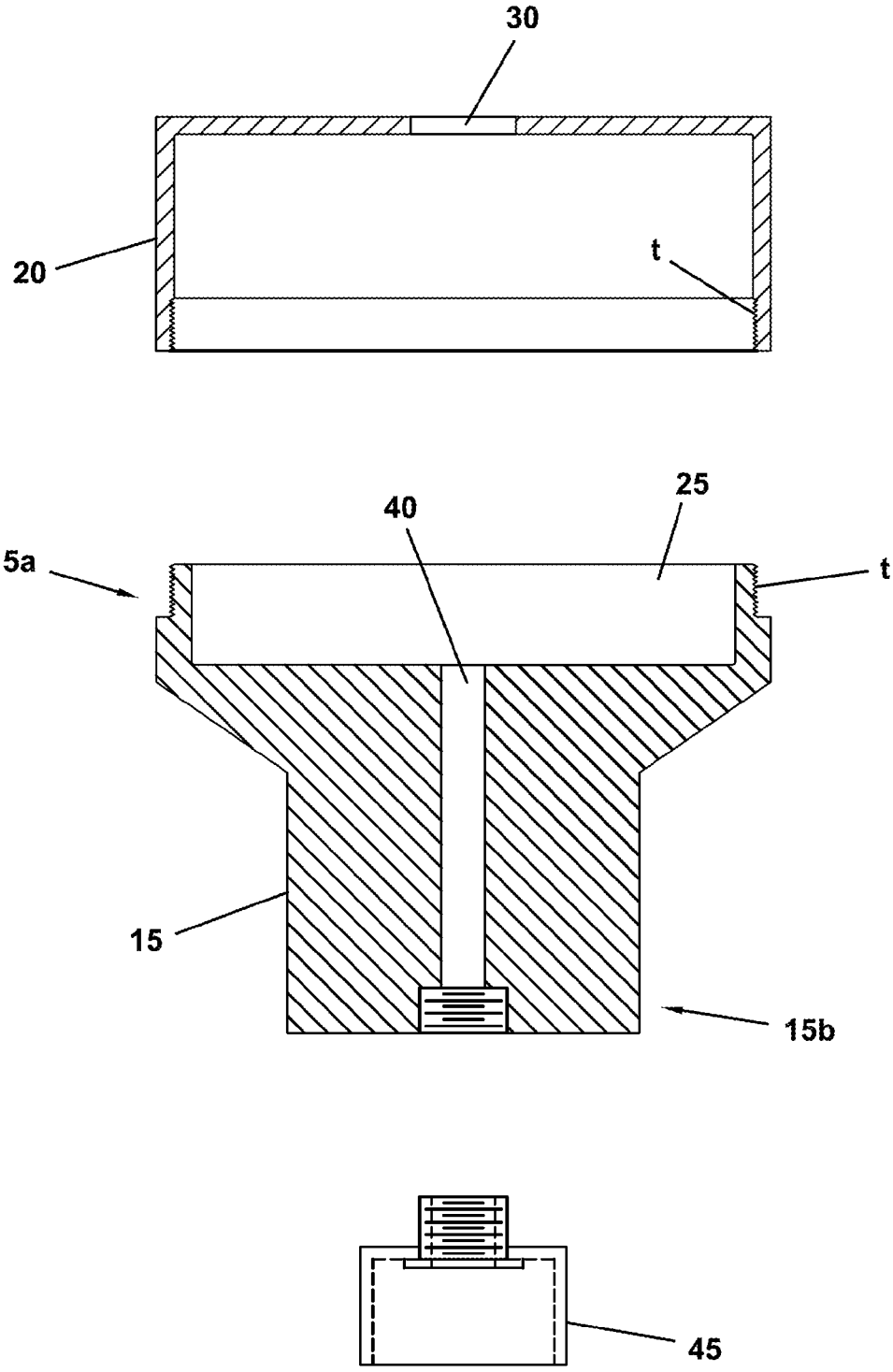
FIG. 2 is an exploded view, in partial cross-section, showing the individual components of the bell cup cleaning device illustrated in FIG. 1.
Figure 3:
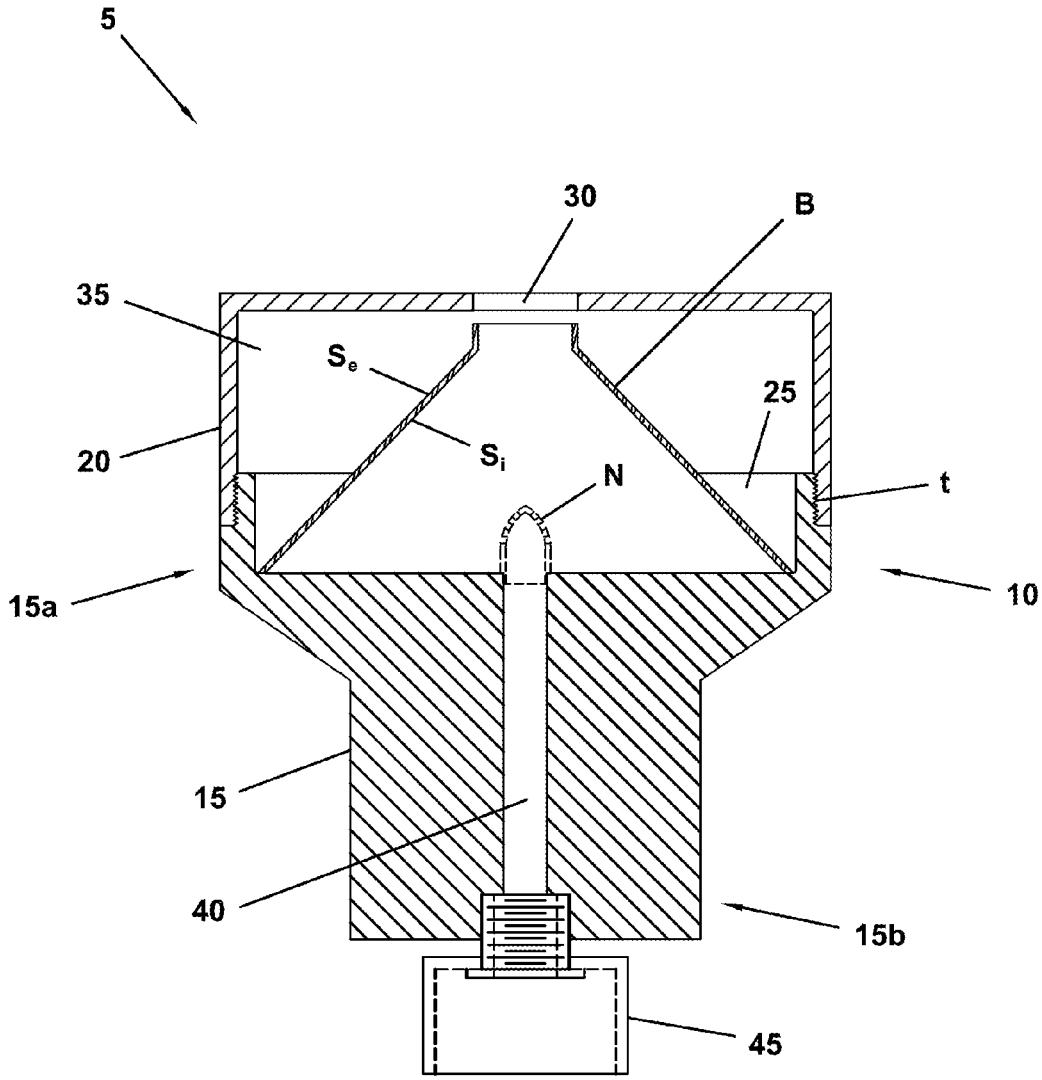
FIG. 3 is a front elevation view, in partial cross-section, showing the bell cup cleaning device components of FIG. 2 in an assembled state, with a bell cup residing therein.
Figure 4:
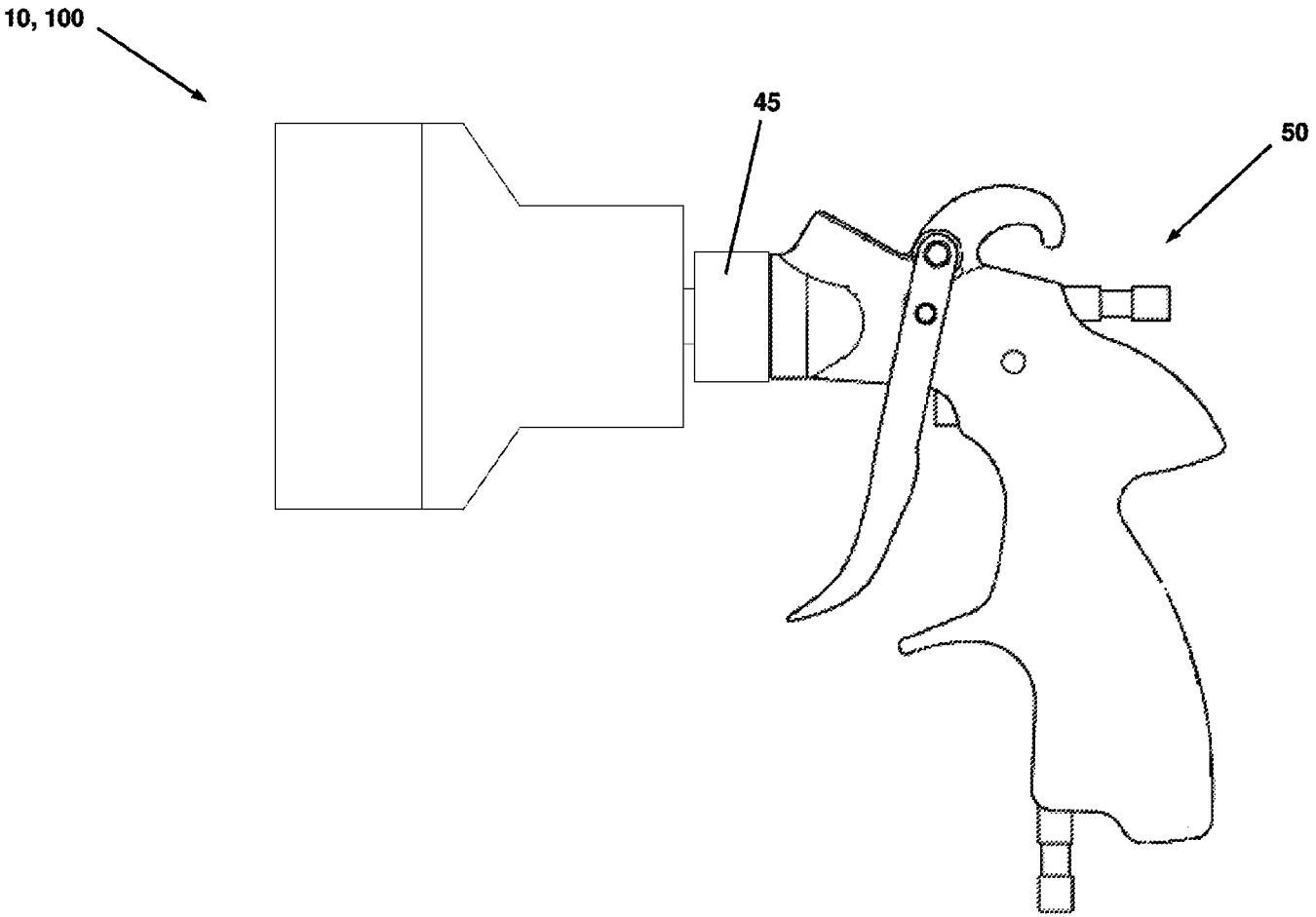
FIG. 4 shows a bell cup cleaning device of the present invention connected to a common paint spray gun.

One exemplary embodiment of a bell cup cleaning device 5 that may be used by a cleaning method of the present invention can be observed in FIGS. 1-3. As can be seen, the bell cup cleaning device 5 includes an enclosure 10 for housing a bell cup B during the cleaning thereof. A connector 45 is also provided to allow for attachment of the bell cup cleaning device 5 to a paint spray gun, as is illustrated in FIG. 4.

In this particular embodiment, the enclosure 10 is comprised of two parts, a bell cup receiving portion 15 and a cap 20. The bell cup receiving portion 15 and cap 20 may be constructed from various materials including, without limitation, plastics and metals. In one particular embodiment, both components are manufactured from Delrin, available from DuPont. Many other materials may be used, however, and the bell cup receiving portion 15 and cap 20 need not necessarily be constructed from the same material.

As can be best observed in FIGS. 2-3, a first end 15*a* of the bell cup receiving portion 15 preferably includes a cavity 25 or other recess for receiving a portion of a bell cup B to be cleaned. The cavity 25 may be of various shape, size and depth. In this exemplary embodiment, the cavity 25 is of circular cross-section in order to best accommodate the shape of the bell cup B. The cavity 25 may be of sufficient diameter to accommodate bell cups of varying size, or it may be designed to work with one particular bell cup. Preferably, the depth of the cavity 25 is at least sufficient to locate the bell cup B within the bell cup receiving portion 15 of the enclosure 10.

This embodiment of the enclosure 10 also includes a cap 20 that is adapted to mate with the bell cup receiving portion 15. The cap 20 is of a shape and size so as to allow the enclosure to accommodate the bell cup B after the cap is mated to the bell cup receiving portion 15. As can be seen in FIGS. 2-3, this embodiment of the cap 20 is provided with a hollow interior space for such purpose. The cap 20 is also provided with a cleaning fluid expulsion hole 30, the purpose of which is described in more detail below.

A cap according to the present invention may also be of various other designs, and may fit into an opening in a bell cup receiving portion instead of over the bell cup receiving portion. In other embodiments, the cap may comprise a substantially hollow ring or other retaining component that functions merely to hold the bell cup in position during cleaning. In such an embodiment, the bell cup may be largely exposed during the cleaning process.

In whatever form, a cap of the present invention is preferably designed to engage the bell cup receiving portion. In this particular embodiment, the bell cup receiving portion 15 and the cap 20 are each provided with threads t that cooperate to retain the cap on the bell cup receiving portion once installed thereto. The bell cup receiving portions and caps of other embodiments of the present invention could also be retained in a variety of other ways that would be understood by one skilled in the art. Such alternatives may include, without limitation, engageable retaining clips or tabs and, when the bell cup cleaning device is appropriately constructed, various well known retention mechanisms including those utilizing plastic deformation (e.g., a ridge that snaps into a retaining groove).

Preferably, but not necessarily, the engagement mechanism used to secure the cap to the bell cup receiving portion of an enclosure of the present invention also acts to substantially seal the joint therebetween. Alternatively, or in addition thereto, one or more seals may be provided for this purpose. While sealing of the joint between the bell cup receiving portion and the cap is not essential to operation of the present invention, it can be understood that preventing or minimizing leaks therefrom would be desirable.

As can be best observed in FIG. 3, the assembled enclosure 10 generally provides a cleaning chamber 35 within which the bell cup B is maintained during the cleaning process. This cleaning chamber 35 is connected to a supply of pressurized cleaning fluid by a passageway 40 that extends from the cavity 25 through a second end 15*b* of the bell cup receiving portion 15.

The second end 15*b* of the bell cup receiving portion 15 may be fitted with a connector 45 that facilitates connection of the enclosure 10 to a source of pressurized cleaning fluid. Alternatively, it may also be possible to inject pressurized cleaning fluid directly into the passageway 40 without the use of a connector.

In one particular embodiment of the present invention, a connector 45 allows for connection of the enclosure 10 to a paint spray gun 50. Such an arrangement can be observed in FIG. 4. In this embodiment, the connector 45 is designed to mate with the threads (not shown) typically present around the nozzle of a common spray gun 50. Consequently, subsequent to removing the spray cap from the spray gun 50, the connector 45 may be threaded thereto. Obviously, the connector 45 could also be adapted to mate with spray guns of different design, whether through threading coupling or otherwise, and all such couplings are considered to be within the scope of the present invention.

Association of a connector with the enclosure 10 may be accomplished in a number or ways. For example, in certain embodiments, the connector may be integrally formed with the bell cup receiving portion 15, such as by molding or machining. In the particular exemplary embodiments shown herein, the connector 45 is attached to the enclosure via threaded engagement, and is designed to be subsequently threaded onto a spray gun. One skilled in the art would realize that there are other ways that a connector could be associated with the enclosure, and such are contemplated by the present invention.

In operation of the bell cup cleaning device 5 depicted in FIG. 4, the spray gun 50 is associated with a supply of pressurized cleaning fluid, whether contained in a paint tank, a pressure pot, or in some other storage vessel. Thus, with the enclosure 10 attached to the spray gun 50 by the connector 45, the spray gun is activated to inject pressurized cleaning fluid into the passageway 40. The pressurized cleaning fluid travels through the passageway 40 and exits into the cleaning chamber 35, where it forcefully makes contact with and flows over the interior surface $S_i$ of the bell cup B. After flowing through the bell cup B, the cleaning fluid exits the enclosure 10 via the cleaning fluid expulsion hole 30 provided in the cap 20. In other embodiments, more than one cleaning fluid expulsion hole may be provided and such hole(s) may be arranged at various locations in the cap and/or the bell cup receiving portion 15.

The flow of the pressurized cleaning fluid over the interior surface $S_i$ of the bell cup B provides for the effective cleaning of paint therefrom. Although not shown in the drawing figures, it is possible to install one or more optional nozzles N at the exit of the passageway 40, such that cleaning fluid can be directed with more control against the interior surface $S_i$ of the bell cup B. As would be understood by one skilled in the art, a variety of nozzle designs could be employed for this purpose. It is also contemplated that a more complex passageway or additional passageways may be employed so that cleaning fluid may also be directed onto the exterior surface $S_e$ of the bell cup B if desired. For example, one or more passageways may exit into the cleaning chamber 35 at a point above the exterior surface $S_e$ of the bell cup B.

If desired, the cleaning process may be performed over a container or in another location so as to allow for the collection of the expelled cleaning fluid. Alternatively, a collection device may be directly associated with the enclosure, such as by its connection to the cleaning fluid expulsion hole 30. For example, a conduit such as a length of flexible tubing may be connected between the cleaning fluid expulsion hole 30 and a collection vessel.

As shown in FIGS. 1-4, pressurized cleaning fluid is introduced to the bell cup B from a direction opposite to that of which paint is introduced to the bell cup during its use in a rotary paint atomizer. By orienting the bell cup as shown in FIGS. 1-4, it can also be understood that pressurized cleaning fluid is directed substantially directly against the paint-covered interior surface $S_i$ of the bell cup B. It is believed that such direct contact enhances the ability of the pressurized cleaning fluid to remove paint from the interior surface $S_i$ of the bell cup B. However, as illustrated in FIG. 5, it is possible to reverse the orientation of the bell cup B within the enclosure 10, although doing so may result in less effective cleaning.

Figure 5:
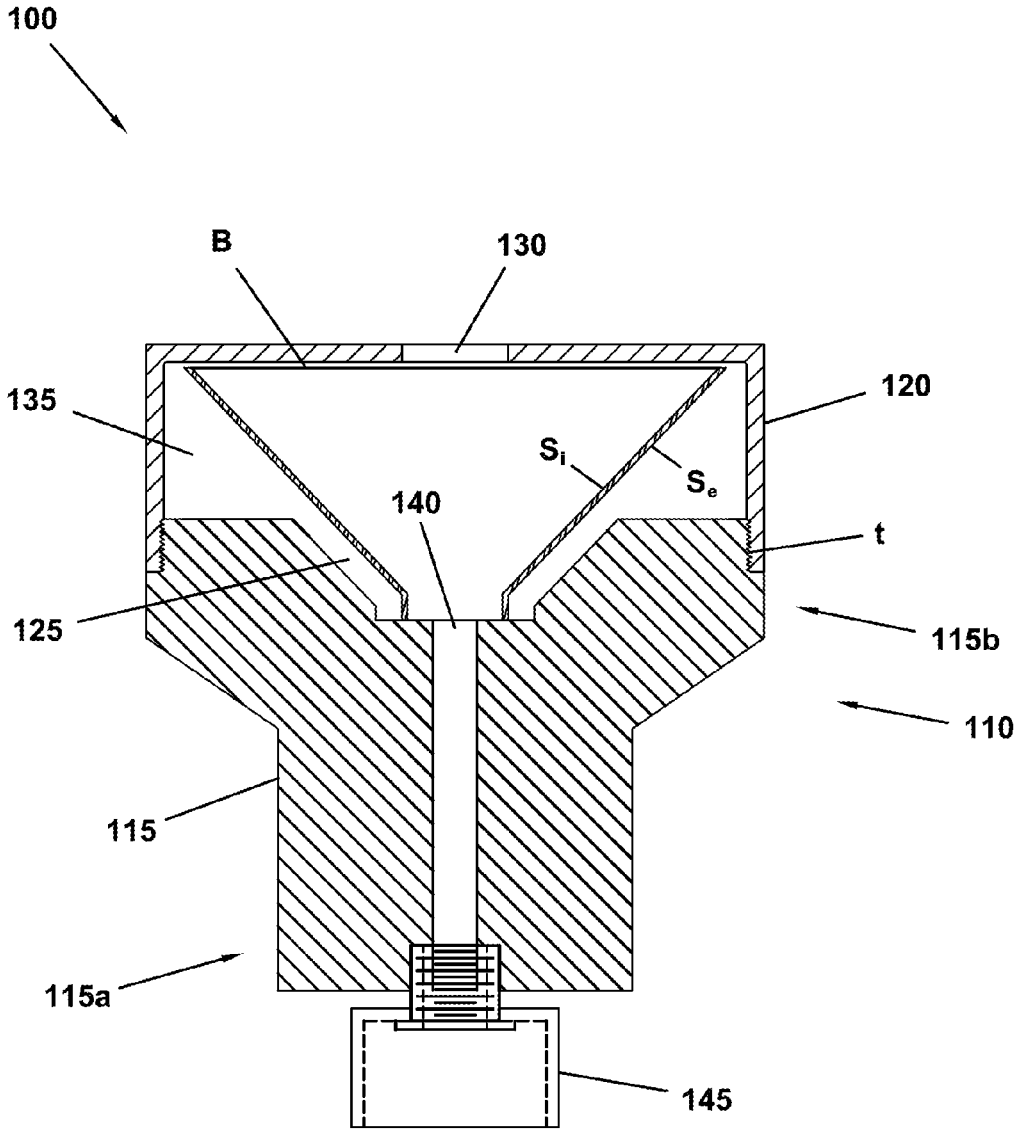
FIG. 5 is a front elevation view, in partial cross-section of an alternative embodiment of an assembled bell cup cleaning device of the present invention, with a bell cup residing therein.

As shown in FIG. 5, a bell cup cleaning device 100 once again includes an enclosure 110 for housing a bell cup B during the cleaning thereof. A connector 145 is also provided to allow for attachment of the bell cup cleaning device 5 to a paint spray gun or other fluid supply device, as can be understood from FIG. 4 and the previous description. Any other feature or variation discussed or mentioned in association with the foregoing exemplary embodiments may be also employed with the embodiment shown in FIG. 5.

The enclosure 110 is once again comprised of two parts, a bell cup receiving portion 115 and a cap 120. The bell cup receiving portion 115 again includes a cavity 125. However, in this embodiment of the bell cup cleaning device 100, the cavity 125 is designed to maintain and locate the bell cup B in a reverse orientation to that shown in FIGS. 2-3. As such, the cavity 125 is preferably, but not necessarily, of a profile that substantially mimics the profile of the bell cup exterior. As shown, the cavity 125 is of substantially frustoconical shape. As with the embodiment 5 described above, the cavity 125 may be of various size and depth to accommodate bell cups of varying size. Alternatively, the cavity 125 may be designed to work with one particular bell cup. Preferably, the depth of the cavity 125 is at least sufficient to locate the bell cup B within the bell cup receiving portion 115 of the enclosure 110.

The enclosure 110 also includes a cap 120 that is adapted to mate with the bell cup receiving portion 115. The cap 120 is of a shape and size so as to allow the enclosure to accommodate the bell cup B after the cap is mated to the bell cup receiving portion 115. As can be seen in FIG. 5, this embodiment of the cap 120 is once again provided with a hollow interior space for such purpose. The cap 120 is also provided with a cleaning fluid expulsion hole 130, the purpose of which has been described above.

The cap 120 may be designed to engage the bell cup receiving portion 115 by any of the techniques previously described or referenced. Consequently, the assembled enclosure 110 again provides a cleaning chamber 135 within which the bell cup B is maintained during the cleaning process. This cleaning chamber 135 is again connected to a supply of pressurized cleaning fluid by a passageway 140 that extends from the cavity 125 through a second end 115*b* of the bell cup receiving portion 115. A connector may again be used to connect the enclosure 110 to a source of pressurized fluid, such as to a paint spray gun.

Operation of the bell cup cleaning device 100 depicted in FIG. 5 is performed in substantially the same manner as that of the device 5 shown in FIGS. 1-4. That is, with the enclosure 110 attached to a spray gun or other fluid delivery device, pressurized cleaning fluid is injected into the passageway 140. The pressurized cleaning fluid travels through the passageway 140 and enters the cleaning chamber 135, where it flows through the rear of the bell cup B and passes over the interior surface $S_i$ thereof before exiting the enclosure 110 via the cleaning fluid expulsion hole 130. In other embodiments, more than one cleaning fluid expulsion hole may be provided and such hole(s) may be arranged at various locations in the cap 120 and/or the bell cup receiving portion 115. The cleaning process may be performed over a container or in another location so as to allow for the collection of the expelled cleaning fluid, or a collection device may be directly associated with the enclosure, as described above.

Although various exemplary embodiments of a bell cup cleaning device of the present invention have been presented herein for purposes of, it should be realized that a multitude of deviations therefrom are possible while still falling within the scope of the present invention. For example, the shape and/or size of the bell cup receiving portion and/or cap may be altered, the enclosure may have an open designs such that at least a portion of the bell cup is exposed, the passageway for supplying pressurized cleaning fluid to the enclosure interior may be changed, a connector may be absent, etc. Therefore, while certain embodiments of the present invention are described in detail above, the scope of the invention is not to be considered limited by such disclosure, and modifications are possible without departing from the spirit of the invention as evidenced by the following claims:

What is claimed is:

1. A method for cleaning a paint bell cup, comprising:

(a) providing an enclosure, said enclosure further comprising:

a bell cup receiving portion and a cap, said bell cup receiving portion having a first end for receiving an end of a bell cup to be cleaned and a second end adapted to receive a supply of pressurized cleaning fluid, said cap adapted to mate with and engage said first end of said bell cup receiving portion so as to form a cleaning chamber within said enclosure, a passageway extending from said second end of said bell cup receiving portion into said cleaning chamber, and at least one cleaning fluid expulsion hole located in said cap and/or said bell cup receiving portion;

(b) locating a bell cup within said enclosure;

(c) placing said passageway of said enclosure in communication with the nozzle end of a spray gun; and (d) introducing pressurized cleaning fluid from a pressurized cleaning fluid source into said passageway via the spray gun;

wherein said pressurized cleaning fluid travels to said cleaning chamber and flows over at least an interior surface of said bell cup prior to being expelled from said at least one cleaning fluid expulsion hole.

2. The method of claim 1, wherein said bell cup is oriented with its interior surface facing said at least one passageway.

3. The method of claim 1, wherein said bell cup is oriented with its interior surface directed away from said at least one passageway.

4. The method of claim 1, wherein a connector is associated with said second end passageway and is used to couple said enclosure to a nozzle end of a spray gun.

5. The method of claim 4, wherein said connector includes threads that are engaged with corresponding threads on the nozzle portion of a spray gun after a spray cap has been removed therefrom.

6. The method of claim 1, further comprising collecting said cleaning fluid as it is expelled from said at least one cleaning fluid expulsion hole.

7. A method for cleaning a bell cup after its removal from a rotary paint atomizer, comprising:

(a) providing an enclosure, said enclosure further comprising:

a bell cup receiving portion and a cap, said bell cup receiving portion having a first end for receiving an end of a bell cup to be cleaned and a second end adapted to receive a supply of pressurized cleaning fluid, said cap adapted to mate with and engage said first end of said bell cup receiving portion so as to form a cleaning chamber within said enclosure, at least one passageway extending from said second end of said bell cup receiving portion into said cleaning chamber, at least one cleaning fluid expulsion hole located in said cap and/or said bell cup receiving portion, and a connector associated with said second end passageway;

(b) locating a bell cup within said enclosure;

(c) coupling said enclosure to the nozzle end of a paint spray gun using said connector; and (d) introducing pressurized cleaning fluid from a pressurized cleaning fluid source into said passageway via the paint spray gun;

wherein said pressurized cleaning fluid travels to said cleaning chamber and flows over at least an interior surface of said bell cup prior to being expelled from said at least one cleaning fluid expulsion hole.

8. The method of claim 7, wherein said bell cup is oriented with its interior surface facing said at least one passageway.

9. The method of claim 7, wherein said bell cup is oriented with its interior surface directed away from said at least one passageway.

10. The method of claim 7, wherein said connector of said enclosure includes threads that are engaged with corresponding threads on the nozzle portion of a spray gun after a spray cap has been removed therefrom.

11. The method of claim 7, further comprising collecting said cleaning fluid as it is expelled from said at least one cleaning fluid expulsion hole.

12. A method for cleaning a paint bell cup after its removal from a rotary paint atomizer, comprising:

(a) providing an enclosure, said enclosure further comprising:

a bell cup receiving portion and a cap, said bell cup receiving portion having a first end for receiving an end of a bell cup to be cleaned and a second end adapted to receive a supply of pressurized cleaning fluid, said cap adapted to mate with and engage said first end of said bell cup receiving portion so as to form a cleaning chamber within said enclosure, at least one passageway extending from said second end of said bell cup receiving portion into said cleaning chamber, at least one cleaning fluid expulsion hole located in said cap and/or said bell cup receiving portion, and a threaded connector installed to said second end passageway;

(b) locating a bell cup within said enclosure;

(c) coupling said enclosure to the nozzle end of a paint spray gun by removing a spray cap from a nozzle portion of the paint spray gun and threading said connector onto corresponding threads on the nozzle portion of the paint spray gun; and (d) introducing pressurized cleaning fluid from a pressurized cleaning fluid source into said passageway via the paint spray gun;

wherein said pressurized cleaning fluid travels to said cleaning chamber and flows over at least an interior surface of said bell cup prior to being expelled from said at least one cleaning fluid expulsion hole.

13. The method of claim 12, wherein said bell cup is oriented with its interior surface facing said at least one passageway.

14. The method of claim 12, wherein said bell cup is oriented with its interior surface directed away from said at least one passageway.

15. The method of claim 12, further comprising collecting said cleaning fluid as it is expelled from said at least one cleaning fluid expulsion hole.

* * * * *